US006042036A

United States Patent [19]

Virving et al.

[11] Patent Number: 6,042,036

[45] Date of Patent: Mar. 28, 2000

[54] REFINING ELEMENT

[75] Inventors: Nils Virving, Hässelby; Peter Bergquist, Haninge; Anders Hawén, Tyresö, all of Sweden

[73] Assignee: Sunds Defibrator Industries AB, Sweden

[21] Appl. No.: 09/091,447

[22] PCT Filed: Dec. 4, 1996

[86] PCT No.: PCT/SE96/01594

§ 371 Date: Jun. 17, 1998

§ 102(e) Date: Jun. 17, 1998

[87] PCT Pub. No.: WO97/23291

PCT Pub. Date: Jul. 3, 1997

[30] Foreign Application Priority Data

Dec. 21, 1995 [SE] Sweden ..... 9504608
Jun. 18, 1996 [SE] Sweden ..... 9602412

[51] Int. Cl.[7] ..... B02C 7/04; B02C 1/10

[52] U.S. Cl. ..... 241/261.3; 241/296; 162/234

[58] Field of Search ..... 162/56, 234, 235, 162/236; 241/261.3, 261.1, 262, 293, 296

[56] References Cited

U.S. PATENT DOCUMENTS

| | | | |
|---|---|---|---|
| 100,537 | 3/1870 | Loy | 241/261.3 |
| 3,974,971 | 8/1976 | Reinhall | 241/261.3 |
| 4,023,737 | 5/1977 | Leider et al. | 241/261.3 |
| 5,181,664 | 1/1993 | Kohler | 241/261.3 |
| 5,362,003 | 11/1994 | Virving | 241/261.3 |

*Primary Examiner*—Christopher A. Fiorilla
*Attorney, Agent, or Firm*—Lerner, David, Littenberg, Krumholz & Mentlik, LLP

[57] ABSTRACT

Refining elements are disclosed for use in refiners in which the refining elements comprise a refining surface with a plurality of raised bars alternating with a plurality of grooves. The raised bars at the inlet of the refining path have a first spacing and form a first angle with respect to a radius or generatrix defining the refining path and the plurality of raised bars at the outlet of the refining path have a second spacing and form a second angle with respect to the radius or generatrix, the first angle being between about 50° and 85° and the second angle being between about −25° and +25°, and the first spacing being greater than the second spacing.

6 Claims, 1 Drawing Sheet

REFINING ELEMENT

FIELD OF THE INVENTION

The present invention relates to refining elements for use in refiners with flat or conical refining surfaces. More particularly, the present invention relates to the type of refiner used for working and refining lignocellulosic fiber material of both low and high material concentration.

BACKGROUND OF THE INVENTION

Refiners having flat refining surfaces generally comprise two refining discs, which rotate relative to each other and which have opposed refining surfaces. In this manner, one refining disc can be rotatable and the other stationary, or both refining discs can be rotatable in opposite directions. The refining surfaces generally consist of refining elements located on each refining disc. These refining elements are provided with a pattern of bars and intermediate grooves. Between the opposed refining elements a refiner gap is formed, through which the material is intended to pass outwardly while simultaneously being worked by the bars of the refining elements.

Refiners with conical refining surfaces comprise a rotor with a conical refining surface which is surrounded by a stator with an opposed conical refining surface. The angle of inclination to the rotor axis is generally less than 45°, preferably 10–30°. The refining surfaces consist of refining elements located on the rotor and stator, respectively. These refining elements are provided with a pattern of bars and intermediate grooves. Between the opposed refining elements a refiner gap is formed, through which the material is intended to pass from the end with the smallest diameter to the end with the largest diameter, while simultaneously being worked by the bars of the refining elements.

The bars on the refining elements can be straight or angled, and the bar-groove ratio can be varied for achieving different refining results. The feed through the refiner gap is affected strongly by centrifugal forces. With increasing diameter in the direction of feed, the centrifugal force, and thus the feed force, also increases. The difference in diameter between the inlet and outlet of the refiner gap implies that the space for the material in the refiner gap can vary by up to 50% between the inlet and outlet portion of the refiner gap. These conditions limit the total capacity, and can cause problems with non-uniform quality of the refined material. Furthermore, there will also be a reduction in the total production due to wear of the bars on the refining elements.

One object of the present invention is to eliminate these problems by about a uniform feed through the entire refiner gap.

SUMMARY OF THE INVENTION

In accordance with the present invention, a more uniform material flow through the refiner gap can be obtained by forming the inlet portion of the refining elements more open and angular downstream of the direction of flow of the pulp therein. In this manner the refining result as well as the production therein can be improved. Indeed, an increase of capacity of from 20 to 25% can now be obtained.

In accordance with the present invention, these and other objects have now been accomplished by the discovery of a refining element for use in a refiner for lignocellulosic material comprising first and second relatively rotatable refining surfaces separated by a refining gap therebetween defining a refining path having an inlet having a first diameter and an outlet having a second diameter, the first diameter being less than the second diameter, a refining element comprising a refining surface including a plurality of raised bars alternating with a plurality of grooves, the plurality of raised bars at said inlet of said refining path having a first spacing and forming a first angle with respect to a radius or generatrix defining the refining path and a plurality of raised bars at the outlet of the refining path having a second spacing and forming a second angle with respect to the radius or generatrix, the first angle being between about 50° and 85° and the second angle being between about −25° and +25°, and the first spacing being greater than the second spacing.

In accordance with a preferred embodiment of the refining elements of the present invention, the plurality of grooves at the inlet has a first total cross-sectional area and the plurality of grooves at the outlet has a second total cross-sectional area, the first total cross-sectional area substantially corresponding to the second total cross-sectional area.

In accordance with one embodiment of the refining element of the present invention, the plurality of raised bars are arcuate and have a successively decreasing angle from the inlet to the outlet.

In accordance with one embodiment of the refining element of the present invention, the first angle is between about 60° and 80°.

In accordance with another embodiment of the refining element of the present invention, the refining element is adapted for use in connection with a refiner having substantially planar first and second relatively rotatable refining surfaces. In another embodiment, however, the refining element is adapted for use in connection with a refining comprising conical first and second relatively rotatable refining surfaces.

BRIEF DESCRIPTION OF THE DRAWINGS

The present invention may be more fully appreciated with reference to the following detailed description, which, in turn, refers to the drawings in which.

DETAILED DESCRIPTION

Figure 1:
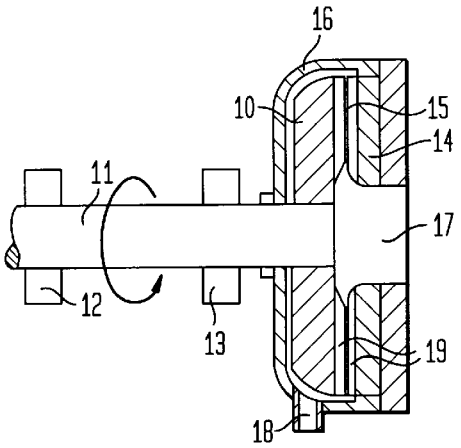
FIG. 1 is a side, elevational, partially schematic view of a refiner having flat refining disc surfaces.

The refiner having flat refining surfaces as shown in FIG. 1 comprises a rotary refining disc (rotor) 10 mounted on a shaft 11 supported in bearings, 12 and 13. A stationary refining disc (stator) 14 is arranged opposite the rotary refining disc 10 so that a refiner gap 15 is formed between the refining surfaces on the rotor 10 and stator 14. The rotor 10 as well as the stator 14 are enclosed in an airtight casing 16, which has a central inlet 17 through the stator 14 inside the refiner gap for the material to be worked, and an outlet 18 for the refined material outside the refiner gap. Working of the material is brought about by the relative rotation between the refining surfaces.

The shaft 11 is movable for adjusting the size of the refiner gap 15 and for producing the required pressure between the refining surfaces.

Figure 2:
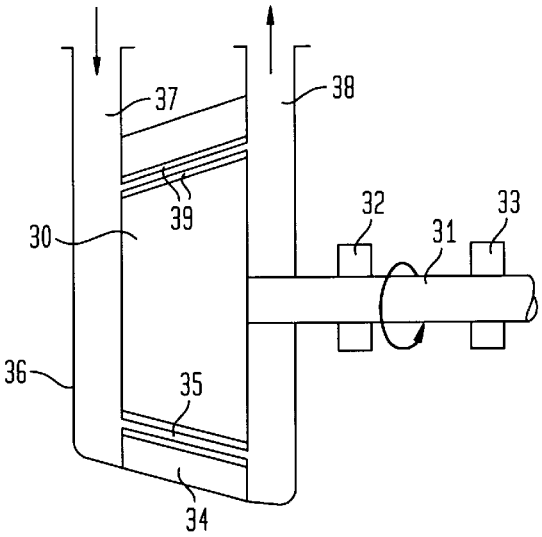
FIG. 2 is a side, elevational, partially schematic view of a refiner having conical refining disc surfaces.

The refiner shown in FIG. 2 comprises a rotor 30 mounted on a rotary shaft 31 supported in bearings, 32 and 33. The rotor 30 is surrounded by a stator 34, in a manner such that a conical refiner gap 35 is formed between the refining surfaces on the rotor 30 and stator 34. The rotor 30 as well as the stator 34 are enclosed in an airtight casing 36, which has an inlet 37 at the narrower end of the conical refiner gap for the material to be worked, and an outlet 38 for the refined material at the opposite end. Working of the material is brought about by the relative rotation between the refining surfaces.

The shaft 31 is movable for adjusting the size of the refiner gap 35 and for producing the required pressure between the refining surfaces.

Figure 3:
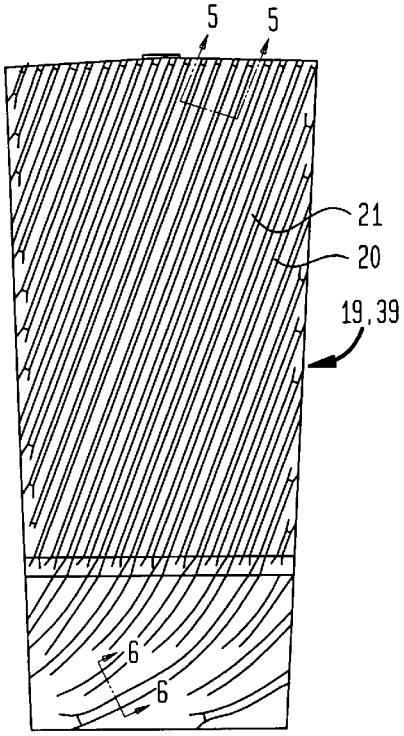
FIG. 3 is a top, elevational view of a refining element in accordance with the present invention.
Figure 5:
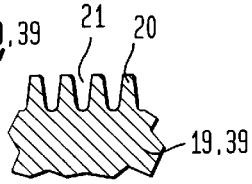
FIG. 5 is partial, side, sectional view of the refining elements shown in FIGS. 3 and 4, taken along lines V—V thereof.
Figure 6:
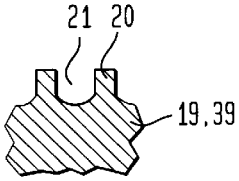
FIG. 6 is a partial, side, sectional view of the refining elements shown in FIGS. 3 and 4, taken along lines VI—VI thereof.

In the refiners according to FIGS. 1 and 2, respectively, the rotor, 10,30, and the stator, 14,34, are provided with a plurality of refining elements, 19 and 39. Each element, 19,39, is formed with a refining surface comprising bars 20 and intermediate grooves 21 which extend substantially over the entire refining surface. In the portion of the refining elements, which is intended to be located closest to the inlet, the bars form an angle of from about 60° to 85°, preferable, from about 50° to 80°, with the radius or generatrix of the refining surface. This angle decreases, preferably successively, along the surface of the refining elements, 19,39, so that the bars 20 at the outlet portion form an angle between about −25° and +25° with respect to the radius or generatrix. According to FIG. 3, each bar 20 forms a bow or arc with successively decreasing angles from the inlet portion to the outlet portion. The total cross-sectional area of the grooves 21 in the inlet portion should substantially correspond to the total cross-sectional area of the grooves in the outlet portion. FIGS. 5 and 6, respectively, are cross-sections of the outlet and inlet, respectively, of the refining elements, 19,39. This implies that the bars 20 in the inlet portion should be located at a greater mutual distance than in the outlet portion.

Figure 4:
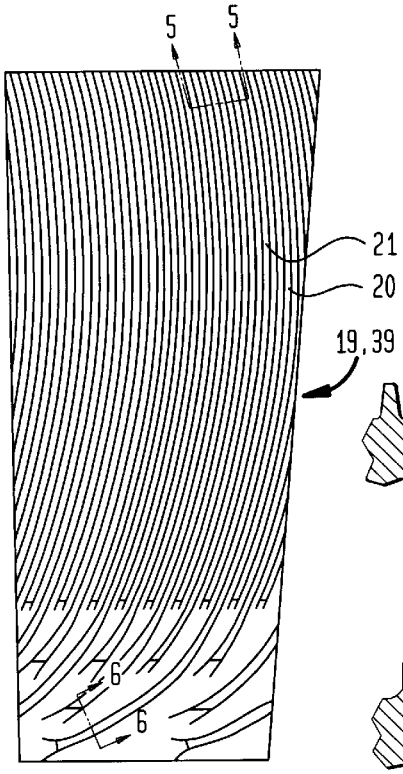
FIG. 4 is top, elevational view of another embodiment of a refining element in accordance with the present invention.

The design of the refining elements, 19,39, has as its object to bring about a uniform feed through the refiner gap. In the inlet portion of the refining element, the centrifugal force, and thus its feeding effect on the material, is at its lowest. Owing to the increasing centrifugal force, the feeding force increases along the refiner gap, 15,35. Due to the angular shape of the bars 20, the feeding force varying in response to the centrifugal force can be compensated for so that a substantially uniform feed along the entire length of the refining element, 19,39, is obtained. This implies that the pumping effect of the bars decreases outwardly, and it even can be negative, i.e. braking, in the outlet end of the refining element. (See FIG. 4.)

For obtaining a uniform feed, it is also necessary that the free inlet volume in the refiner gap, 15,35, substantially corresponds to the free outlet volume. This can be achieved by arranging the bars 20 more sparsely in the inlet portion. The total cross-sectional area of the grooves 21 in the inlet portion can substantially correspond to the total cross-sectional area of the grooves in the outlet portion.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A refining element for use in a refiner for lignocellulosic material comprising first and second relatively rotatable refining surfaces separated by a refining gap therebetween defining a refining path having an inlet having a first diameter and an outlet having a second diameter, said first diameter being less than said second diameter, said refining element comprising a refining surface including a plurality of raised bars alternating with a plurality of grooves, said plurality of raised bars at said inlet of said refining path have a first spacing and forming a first angle with respect to a radius or generatrix defining said refining path and said plurality of raised bars at said outlet of said refining path having a second spacing and forming a second angle with respect to said radius or generatrix, said first angle being between about 50 and 85° and said second angle being between about −25 and +25° and the first spacing being greater than said second spacing.

2. The refining element of claim 1 wherein said plurality of grooves at said inlet has a first total cross-sectional area and said plurality of grooves at said outlet has a second total cross-sectional area, said first total cross-sectional area substantially corresponding to Lid second total cross-sectional area.

3. The refining element of claim 1 wherein said plurality of raised bars are arcuate and have a successively decreasing angle from said inlet to said outlet.

4. The refining element of claim 1 wherein said first angle is between about 60 and 80°.

5. The refining element of claim 1 for use in connection with a refiner having substantially planar first and second relatively rotatable refining surfaces.

6. The refining element of claim 1 for use in connection with a refiner comprising conical first and second relatively rotatable refining surfaces.

* * * * *

UNITED STATES PATENT AND TRADEMARK OFFICE

CERTIFICATE OF CORRECTION

PATENT NO. : 6,042,036

DATED : March 28, 2000

INVENTOR(S) : Virving et al.

It is certified that error appears in the above-indentified patent and that said Letters Patent is hereby corrected as shown below:

Col. 3, line 29, after "bars" insert --30--.

Col. 4, line 43m "Lid" should read --said--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*